US006427637B1

(12) United States Patent
Ineichen

(10) Patent No.: US 6,427,637 B1
(45) Date of Patent: Aug. 6, 2002

(54) STEAM GENERATOR WITH AT LEAST PARTIALLY DOUBLE-WALLED EVAPORATION TANK

(75) Inventor: Kurt Ineichen, Emmenbrücke (CH)

(73) Assignee: Axair AG, Pfaffikon (CH)

( * ) Notice: Subject to any disclaimer, the term of this patent is extended or adjusted under 35 U.S.C. 154(b) by 0 days.

(21) Appl. No.: 09/763,798

(22) PCT Filed: Sep. 13, 1999

(86) PCT No.: PCT/CH99/00432

§ 371 (c)(1),
(2), (4) Date: Feb. 27, 2001

(87) PCT Pub. No.: WO00/17582

PCT Pub. Date: Mar. 30, 2000

(30) Foreign Application Priority Data

Sep. 22, 1998 (CH) ..... 1930/98

(51) Int. Cl.[7] ..... F22B 37/36
(52) U.S. Cl. ..... 122/6 A; 122/19.2; 122/460
(58) Field of Search ..... 122/6 A, 13.01, 122/36, 37, 19.2, 160, 332, 338, 460, 467

(56) References Cited

U.S. PATENT DOCUMENTS 3,873,806 A 3/1975 Schossow
4,493,291 A * 1/1985 Zabelka ..... 122/6 A
4,513,694 A * 4/1985 Wiemer ..... 122/6 A
4,707,163 A * 11/1987 Gudymov et al. ..... 122/6 A
4,813,382 A * 3/1989 Lindermann et al. ..... 122/6 A

FOREIGN PATENT DOCUMENTS

DE 2642911 1/1978
JP 2253803 10/1990

* cited by examiner

*Primary Examiner*—Gregory Wilson
(74) *Attorney, Agent, or Firm*—Selitto, Behr & Kim

(57) ABSTRACT

The invention relates to a steam generator comprising an evaporation tank and several heating elements (2). The evaporation tank consists of an evaporation vessel (1) and a removable limescale rectacle (4) positioned below same. The evaporation vessel (1) is configured as a double-walled vessel having an inner wall (11) and an outer wall (12) which define an outer chamber (13). The inner wall (11) has four inner water-flow openings (111) which connect the interior of the vessel with the outer chamber (13) and the outer wall (12) has outer water-flow openings (121, 122). Water is delivered to and withdrawn from the vessel via the outer flow openings (121, 122), the outer wall (13) and the inner flow opening (111).

33 Claims, 3 Drawing Sheets

STEAM GENERATOR WITH AT LEAST PARTIALLY DOUBLE-WALLED EVAPORATION TANK

The present invention relates to a steam generator with an evaporation tank and at least one heating body.

Steam generators are, for example, employed for air humidification and generally comprise an evaporation tank which is partially filled with water. The water is heated and evaporated by means of heating bodies, such as electrodes or electrical resistances, for example, in which process mineral salts are precipitated which have to be removed from time to time from the evaporation tank by blowdown. For this purpose, in order to top up with water and, in some cases, also to monitor the water level by means of a float in a float tank outside the evaporation tank, the latter has at least one water passage opening, which is frequently arranged in the bottom of the evaporation tank.

Particularly when water with a very high lime content is employed, a major problem is the formation of limescale and the rapid closing up of the usually relatively small water passage opening or openings, which often makes cleaning necessary after only a short period. If larger water passage openings are employed, the blowdown quantity can scarcely be controlled with respect to time and the danger exists that the water in the evaporation tank will start to oscillate shortly after the blowdown.

In order to keep the time intervals between the cleaning operations as large as possible, attempts have been made to provide the water passage openings with devices which prevent rapid blockage. Known arrangements are, for example, the use of screens with a plurality of suitably arranged openings and the pumping of air through the openings from below in order, by this means, to keep water paths free. Also known are openings which are cleaned by moving parts. The solutions proposed, however, do not permit the maintenance cycles to be increased in a satisfactory manner for all types of water.

In view of the problem, with certain types of water, that the water passage openings rapidly form limescale in the previously known steam generators, the invention is based on the following object. A steam generator is to be created with an evaporation tank with at least one water passage opening which does not form limescale or, at least, forms limescale more slowly than the water passage openings of the previous steam generators.

This object is achieved by means of the steam generator according to the invention, as defined in the independent claim 1. Preferred embodiment variants are given in the dependent claims.

The essence of the invention consists in the fact that, in a steam generator with an evaporation tank and at least one heating body, the evaporation tank has an at least partially double-walled design with an inner wall and an outer wall which bound an outer chamber. The inner wall has at least one inner water passage opening connecting the inside of the tank to the outer chamber and the outer wall has at least one outer water passage opening, so that the water supply to the inside of the tank and the water withdrawal from the inside of the tank take place by means of the outer water passage opening or at least one of the outer water passage openings, the outer chamber and the inner water passage opening or at least one of the inner water passage openings.

The inner water passage opening or water passage openings, which are subjected to the hot water, which is precipitating lime, on the inside of the tank can be selected as relatively large openings so that they do not close up too rapidly. The water supplied from the outside, which penetrates through the at least one outer water passage opening into the outer chamber and from there through the at least one inner water passage opening into the inside of the tank, is heated so little during this time that practically no lime is precipitated in the outer chamber. In consequence, only relatively little lime passes to the outer water passage opening or openings so that these can be selected as smaller openings. In this way, the maintenance cycles of the steam generator can be increased without, in the process, having to make concessions with respect to the control of the blowdown necessary from time to time or to the stability of the water level in the evaporation tank.

In a preferred embodiment variant, the evaporation tank comprises an evaporation vessel, which has an opening at the bottom and, arranged underneath it, an exchangeable lime receptacle with a filling opening, so that lime precipitated inside the evaporation vessel passes through the evaporation vessel opening and the filling opening into the lime receptacle. This avoids the inside of the evaporation vessel being filled with lime and the lime precipitated does not have to be removed so rapidly. In addition, removal of the lime is simpler, particularly when the lime receptacle is replaced or emptied before it is completely full of lime.

The double-walled part of the evaporation tank can be located either on the evaporation vessel or on the lime receptacle or on both.

It is advantageous for an approximately horizontal or outwardly inclined lime deposition surface, which can be formed, in particular, by the inside of a part of the outer wall, to be arranged in the outer chamber. This lime deposition surface captures lime particles which flow through the at least one inner water passage opening into the outer chamber, and the lime released in the outer chamber itself, even before the outer water passage opening or openings.

The steam generator according to the invention is described in more detail below using an embodiment example with reference to the attached drawings. In these:

FIGS. 1 TO 3

Figure 1:
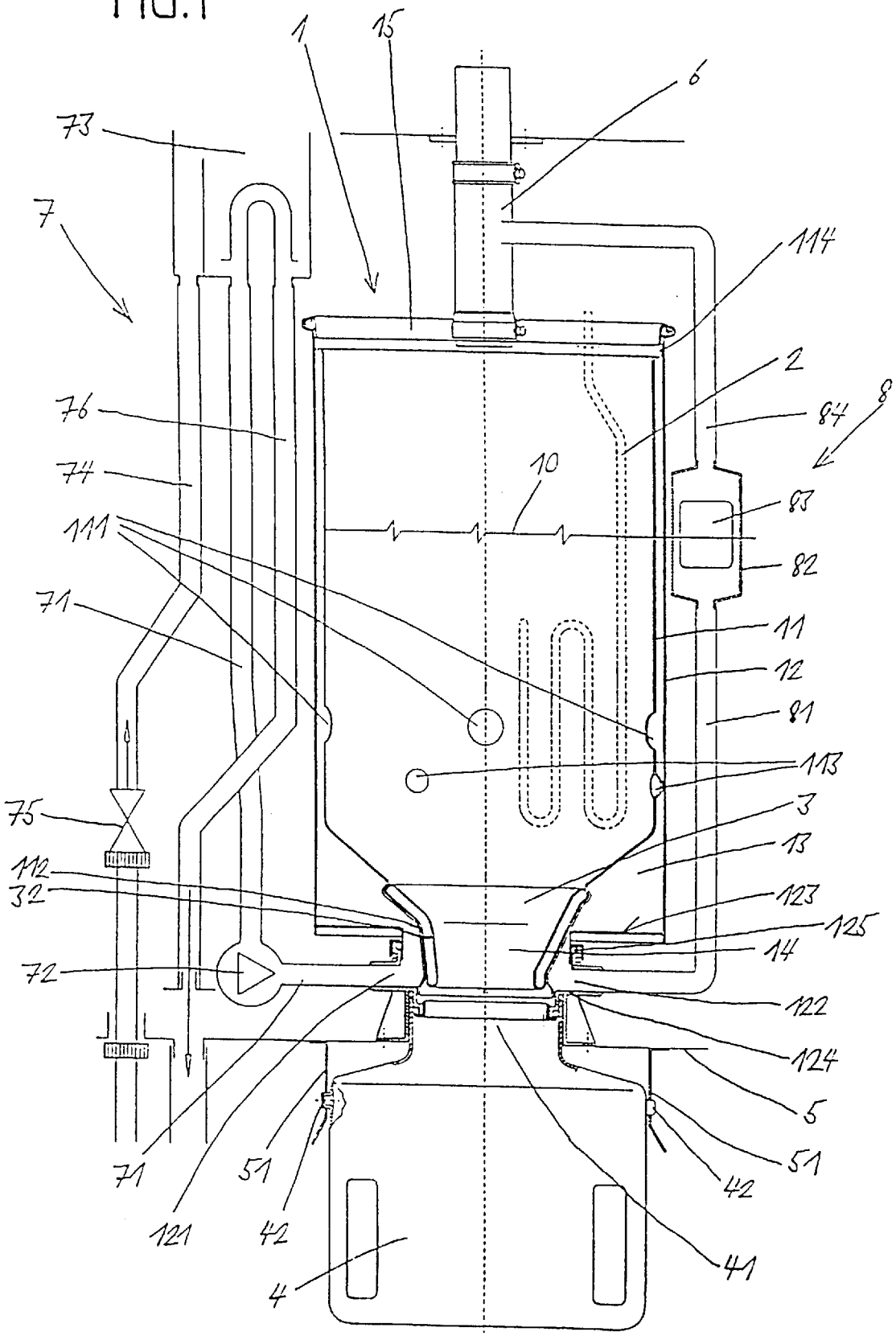
FIG. 1 shows a diagrammatic, partially sectioned view of a steam generator according to the invention.
Figure 2:
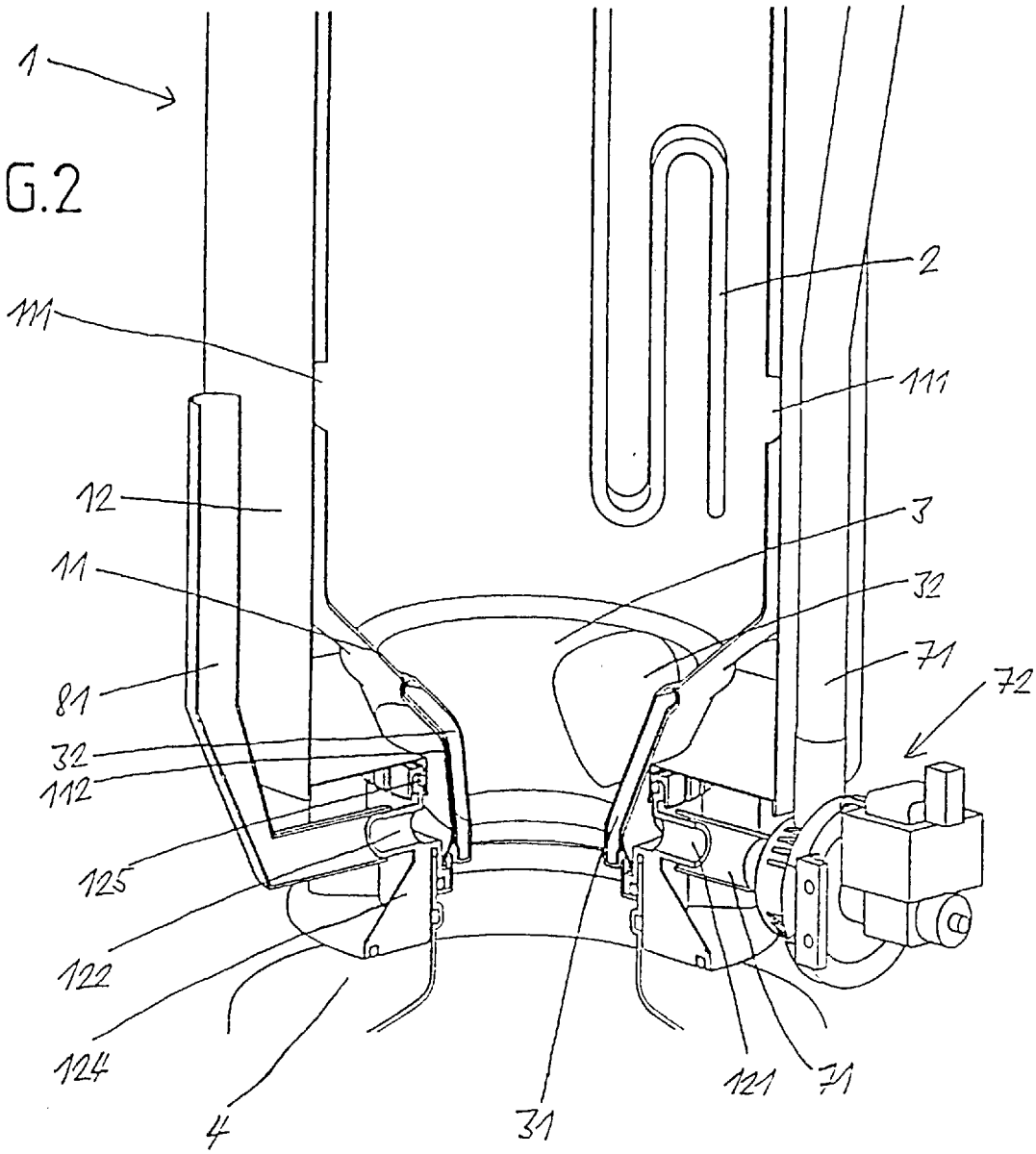
FIG. 2 shows a partially sectioned perspective view of a part of the steam generator of FIG. 1.
Figure 3:
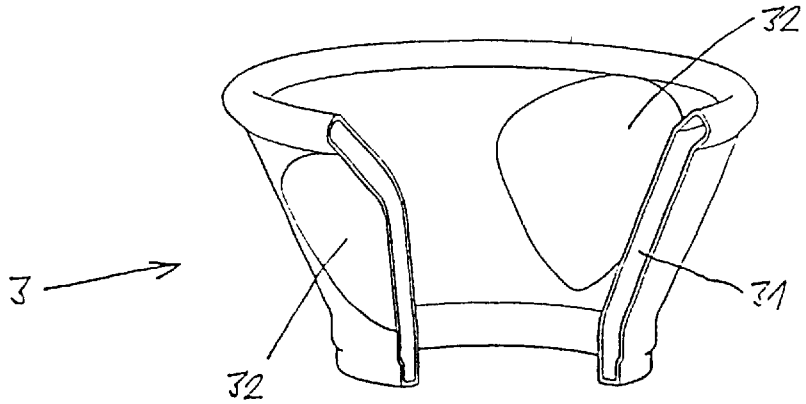
FIG. 3 shows a partially sectioned perspective view of an insulation insert of the steam generator of FIG. 1.

The steam generator shown comprises an evaporation tank with an evaporation vessel 1 and a lime receptacle 4. The evaporation vessel 1 has a cover 15 to which are fastened a plurality of heating bodies 2, for example resistance heating elements, which protrude into the inside of the tank, only one of the resistance heating elements being shown here for ease of viewing. The evaporation vessel 1 is approximately two-thirds filled with water. During operation, the water level 10 is not homogeneous because of the boiling water. The steam generated is withdrawn via a steam line 6.

The evaporation vessel 1 has a double-walled design with an inner wall 11 and an outer wall 12, which bound an outer chamber 13, and has an opening 14 at the bottom. In the embodiment example shown, the outer wall 12 is essentially cylindrical with a shoulder forming a horizontal lime deposition surface 123. The upper part of the inner wall 11 is likewise cylindrical, whereas the lower part is funnel-shaped, so that lime, which has been precipitated and has cracked off the inner wall 11 or the heating bodies 2, slides down. The distance between the inner wall 11 and the outer wall 12 is approximately 10 mm in the upper part and is ensured by bulges 113 and an outwardly bent upper edge 114 of the inner wall 11. In the lower part, the lime deposition surface 123 extends as far as the inner wall 11, the latter having two indentations 112, which arrangement permits a through-flow of water between the edge of the lime deposition surface 123 and the inner wall 11. The outer chamber 13 has a continuous configuration around the inner wall 11 below and above the lime deposition surface 123.

The inside of the evaporation tank is connected to the outer chamber 13 by means of four inner water passage openings 111 in the inner wall 11. Two outer water passage openings 121, 122 are arranged in the outer wall 12 below the lime deposition surface 123. The inner water passage openings 111 have a diameter of approximately 30 mm and do not therefore close up all too rapidly. The outer water passage openings 121, 122 have a diameter of approximately 20 mm so that, on the one hand, any lime pieces which may be entrained during blowdown can be washed out but, on the other hand, no danger exists of the water in the evaporation tank starting to oscillate after the blowdown.

Inserted in the funnel-shaped part of the inner wall 11 is a likewise funnel-shaped insulation insert 3 with two indentations 32, which are designed to correspond with the indentations 112 in the inner wall 11. This insulation insert 3 thermally insulates the outer chamber 13 in the region of the lime deposition surface 123 and the outer water passage openings 121, 122 relative to the inside of the tank and ensures that the water temperature in this region is less than 50° C. The insulation insert 3 shown is designed, for this purpose, as a water-tight pneumatic part with an air-filled cavity 31 but could also be a water-tight, welded, multi-part plastic injection part with a cavity, a water-tight, welded, multi-part metal part with a cavity, a thick-walled part, in particular in elastomer, or a plastic injection part with gaseous inclusions, in particular air inclusions, or could consist of a cellular substance type of material.

Below the lime deposition surface 123, the outer wall 12 comprises a connecting sleeve 124, which is permanently connected to the rest of the outer wall 12, an annular seal 125 ensuring the sealing. The exchangeable lime receptacle 4 with filling opening 41, in which the lime precipitated in the evaporation vessel 1 and cracked off from the inner wall 11 or the heating bodies 2 collects, is arranged on the connecting sleeve 124. The lime receptacle 4 has two lugs 42, which are hooked, in order to fasten it, into two holes of two retention parts 51 extending down from a platform 5.

A water supply and withdrawal device 7 is connected to the water passage opening 121 and a water level monitoring device 8 is connected to the water passage opening 122.

The water level monitoring device 8 comprises a water line 81 leading from the outer water passage opening 122 to a float housing 82 and a pressure balance line 84 leading from the float housing 82 to the steam line 6. A float 83 is arranged in the float housing 82. This float indicates the height of the water level 10, which is the same in the float housing 82 and in the evaporation tank because the inside of the float housing 82 is in connection with the inside of the evaporation tank via the water line 81, the outer water passage opening 122, the outer chamber 13 and the inner water passage openings 111. The float position can be electronically recorded and employed for controlling the water level 10.

The water supply and withdrawal device 7 comprises a water line 71 leading from the outer water passage opening 121 to an inlet basin 73, which is open at the top. A pump 72, by means of which water can be pumped out from the inside of the tank via the outer water passage opening 121, the outer chamber 13 and the inner water passage openings 111, is arranged in the water line 71. A water supply line 74 with a valve 75 leads to the inlet basin 73 and a water outlet line 76 leads away from the inlet basin 73.

During blowdown, the water flowing down from the evaporation tank passes via the inner water passage openings 111 from the inside of the tank into the outer chamber 13 and from there, via the outer water passage opening 121, into the water supply and withdrawal device 7. Any lime precipitations or lime chips which pass through the inner water passage openings 111 into the outer chamber 13 are deposited on the lime deposition surface 123. Practically no lime, therefore, passes to the outer water passage openings 121, 122 so that these do not close up despite their relatively small diameter.

In order to replace water evaporating during operation, the water inside of the tank is topped up by means of the pressure of the static head of water, via the water line 71, the outer water passage opening 121, the outer chamber 13 and the inner water passage openings 111. This top-up water is not heated above the lime precipitation temperature of approximately 50° C. in the outer chamber 13 and, therefore, no lime is released there.

The following applies with respect to the further description. If, for the purpose of avoiding ambiguity in the drawing, designations are contained in the figure which are not explained in the immediately associated descriptive text, reference should be made to where they are mentioned in the preceding figure descriptions.

FIGS. 4 AND 5

Figure 4:
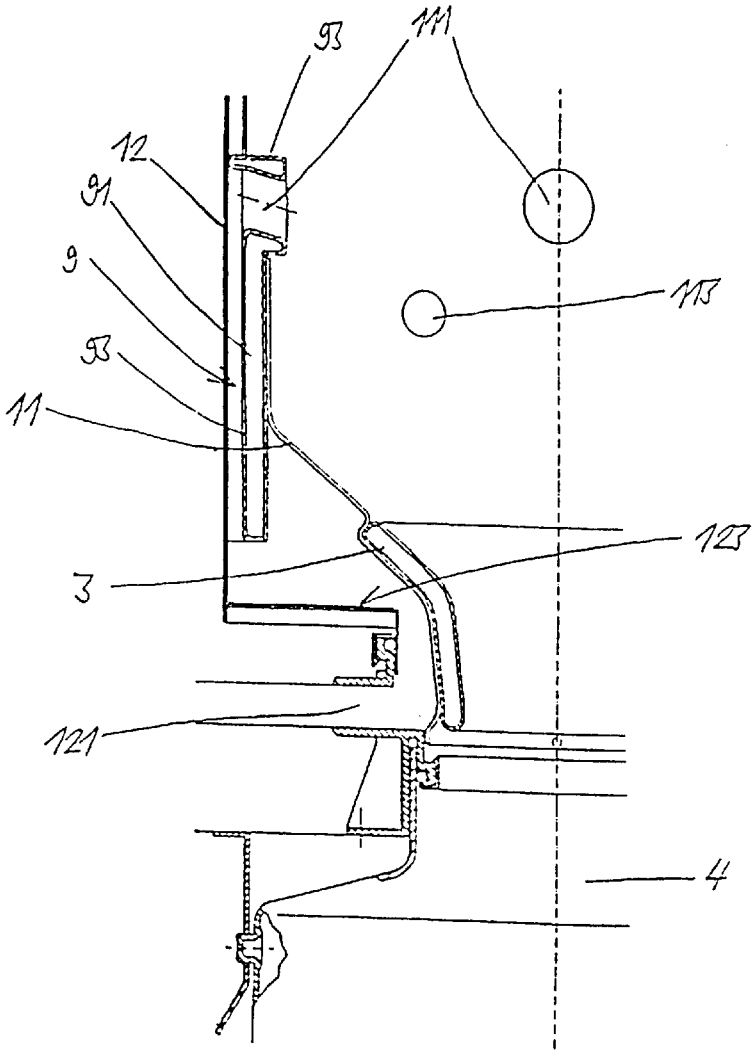
FIG. 4 shows a partial view of a steam generator according to the invention, similar to FIG. 1 but with an additional insulating part.
Figure 5:
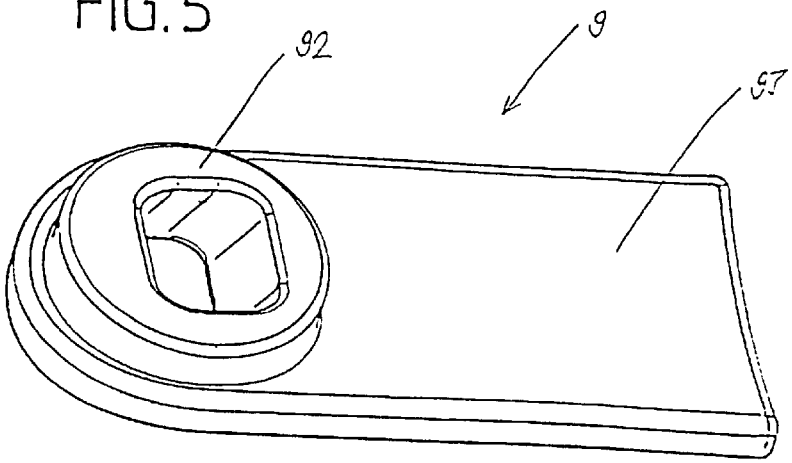
FIG. 5 shows a perspective view of an insulating part of the steam generator of FIG. 4.

The steam generator shown in FIG. 4 is similarly constructed to that shown in FIG. 1 but has, between the inner wall 11 and the outer wall 12, one insulating part 9 per inner water passage opening 111 for thermal insulation of the outer chamber 13 relative to the inside of the tank. The insulating parts 9 respectively extend downward from the relevant inner water passage opening 111 to a little below the level of the upper edge of the funnel-shaped insulation insert 3. They thermally insulate the outer chamber 13 above the lime deposition surface 123 relative to the inside of the tank. The insulating part 9 shown is configured for this purpose as a water-tight pneumatic part with an air-filled cavity 91, but could also be a water-tight, welded, multi-part plastic injection part with a cavity, a water-tight, welded, multi-part metal part with a cavity, a thick-walled part, in particular in elastomer, or a plastic injection part with gaseous inclusions, in particular air inclusions, or could consist of a cellular substance type of material. It has an anchoring part 92 extending into the relevant inner water passage opening 111 and a bent shell part 93 corresponding to the inner wall 11.

Further design variations can be realized relative to the steam generator according to the invention and previously described. Expressly mentioned here are, in addition:

Instead of providing a separate insulation insert 3 for thermal insulation of the outer chamber 13 relative to the inside of the tank, the inner wall 11 can also be configured so that it is better insulated in the desired region, for example by the inclusion of a cavity, thick-walled configuration and/or the employment of a suitable material.

Instead of being arranged below the lime deposition surface 123, the outer water passage openings 121, 122 can also be arranged in the region of the lime deposition surface 123.

Instead of one insulating part 9 per inner water passage opening 111, a single insulating part extending around the inner wall 11 can be provided.

What is claimed is:

1. A steam generator with an evaporation tank (1, 4) and at least one heating body (2), characterized in that the evaporation tank (1, 4) has an at least partially double-walled design with an inner wall (11) and an outer wall (12) which bound an outer chamber (13), the inner wall (11) having at least one inner water passage opening (111) connecting the inside of the tank to the outer chamber (13) and the outer wall (12) having at least one outer water passage opening (121, 122), so that the water supply to the inside of the tank and the water withdrawal from the inside of the tank takes place by means of the outer water passage opening or at least one of the outer water passage openings (121, 122), the outer chamber (13) and the inner water passage opening or at least one of the inner water passage openings (111).

2. The steam generator as claimed in claim 1, characterized in that the distance between the inner wall (11) and the outer wall (12) is between about 3 mm and about 30 mm.

3. The steam generator as claimed in claim 1, characterized in that the evaporation tank comprises an evaporation vessel (1), which has an opening (14) at the bottom and, arranged underneath it, an exchangeable lime receptacle (4) with a filling opening (41), so that lime precipitated inside the evaporation vessel (1) passes through the evaporation vessel opening (14) and the filling opening (41) into the lime receptacle (4).

4. The steam generator as claimed in claim 3, characterized in that a double-walled part of the evaporation tank is located on the evaporation vessel (1).

5. The steam generator as claimed in claim 4, characterized in that the double-walled part of the evaporation tank with the outer wall passage opening or openings is located on the lime receptacle (4).

6. The steam generator as claimed in claim 1, characterized in that, in the region of the outer water passage opening or openings (121, 122), the outer chamber (13) is thermally insulated relative to the inside of the tank in such a way that the water temperature in this region is less than 60° C.

7. The steam generator as claimed in claim 6, characterized in that the thermal insulation of the outer chamber (13) relative to the inside of the tank takes place by means of an insulation insert (3).

8. The steam generator as claimed in claim 7, characterized in that the lower part of the inner wall (11) and the insulation insert (3) each have a funnel-shaped design.

9. The steam generator as claimed in claim 7, characterized in that an approximately horizontal lime deposition surface (123) is formed by the inside of a part of the outer wall (12), in the outer chamber (13), and reaches as far as the inner wall (11), and wherein the inner wall (11) and the insulation insert (3) each have at least one indentation (32, 112) which permits a flow of water between the edge of the lime deposition surface (123) and the inner wall (11).

10. The steam generator as claimed in claim 7, characterized in that the insulation insert (3) comprises a water-tight pneumatic part with a cavity.

11. The steam generator as claimed in claim 7, characterized in that the insulation insert (3) comprises a water-tight, welded, multi-part plastic injection part with a cavity.

12. The steam generator as claimed in claim 7, characterized in that the insulation insert (3) comprises a water-tight, welded, multi-part metal part with a cavity.

13. The steam generator as claimed in claim 7, characterized in that the insulation insert (3) comprises a thick-walled part made of elastomer.

14. The steam generator as claimed in claim 7, characterized in that the insulation insert (3) comprises a plastic injection part with gaseous inclusions.

15. The steam generator as claimed in claim 7, characterized in that the insulation insert (3) comprises a cellular substance type of material.

16. The steam generator as claimed in claim 7, characterized in that an outwardly inclined lime deposition surface (123) is formed by the inside of a part of the outer wall (12), in the outer chamber (13), and reaches as far as the inner wall (11), and wherein the inner wall (11) and the insulation insert (3) each have at least one indentation (32, 112) which permits a flow of water between the edge of the lime deposition surface (123) and the inner wall (11).

17. The steam generator as claimed in claim 6, characterized in that the water temperature in the region of the outer water passage opening or openings (121, 122) is less than 50° C.

18. The steam generator as claimed in claim 1, characterized in that the lower part of the inner wall (11) has a funnel-shaped design.

19. The steam generator as claimed in claim 1, characterized in that an approximately horizontal lime deposition surface (123) is formed by the inside of a part of the outer wall (12) and arranged in the outer chamber (13).

20. The steam generator as claimed in claim 1, characterized in that at least one insulating part (9), for the thermal insulation of the outer chamber (13) relative to the inside of the tank, is arranged between the inner wall (11) and the outer wall (12), which insulating part (9) extends from the inner water passage opening or openings (111) downward.

21. The steam generator as claimed in claim 20, characterized in that the at least one insulating part (9) comprises a water-tight pneumatic part with a cavity.

22. The steam generator as claimed in claim 20, characterized in that the at least one insulating part (9) comprises a water-tight, welded, multi-part plastic injection part with a cavity.

23. The steam generator as claimed in claim 20, characterized in that the at least one insulating part (9) comprises a water-tight, welded, multi-part metal part with a cavity.

24. The steam generator as claimed in claim 20, characterized in that the at least one insulating part (9) comprises a thick-walled part made of elastomer.

25. The steam generator as claimed in claim 20, characterized in that the at least one insulating part (9) comprises a plastic injection part with gaseous inclusions.

26. The steam generator as claimed in claim 20, characterized in that the at least one insulating part (9) comprises a cellular substance type of material.

27. The steam generator as claimed in one of claims 1 to 5, characterized in that the inner water passage opening or water passage openings (111) have a diameter between 10 and 50 mm, and the outer water passage opening or water passage openings (121, 122) have a diameter between 10 and 40 mm.

28. The steam generator as claimed in claim 27, characterized in that the inner water passage opening or water passage openings (111) have a diameter between 20 and 40 mm.

29. The steam generator as claimed in claim 27, characterized in that the outer water passage opening or water passage openings (121, 122) have a diameter between 15 and 25 mm.

30. The steam generator as claimed in claim 1, characterized in that the distance between the inner wall (11) and the outer wall (12) is approximately 10 mm.

31. The steam generator as claimed in claim 1, characterized in that an outwardly inclined lime deposition surface (123) is formed by the inside of a part of the outer wall (12) and arranged in the outer chamber (13).

32. The steam generator as claimed in claim 19 or 31, characterized in that the outer chamber (13) is continuous around the inner wall (11) below the lime deposition surface (123) and the outer water passage opening or openings (121, 122) are arranged in this region.

33. The steam generator as claimed in claim 19 or 31, characterized in that the lime deposition surface (123) reaches as far as the inner wall (11) and the inner wall (11) has at least one indentation (112) which permits a flow of water between the edge of the lime deposition surface (123) and the inner wall (11).

* * * * *